United States Patent [19]

Krün

[11] Patent Number: 4,805,428

[45] Date of Patent: Feb. 21, 1989

[54] LOCK AND KEY

[75] Inventor: Jürgen Krün, Berlin, Fed. Rep. of Germany

[73] Assignee: Zeiss Ikon AG, Fed. Rep. of Germany

[21] Appl. No.: 81,230

[22] Filed: Aug. 4, 1987

[30] Foreign Application Priority Data

Aug. 6, 1986 [DE] Fed. Rep. of Germany ..... 3626550

[51] Int. Cl.[4] ..... E05B 19/00

[52] U.S. Cl. ..... 70/393; 70/406

[58] Field of Search ..... 70/346, 347, 402, 403, 70/405, 406, 407, 375, 358, 364 R, 371

[56] References Cited

U.S. PATENT DOCUMENTS

| | | | |
|---|---|---|---|
| 884,165 | 4/1908 | Julig | 70/406 |
| 1,287,882 | 12/1918 | Christoph | 70/407 |
| 1,804,955 | 5/1931 | Schlumpf | 70/346 |
| 1,958,603 | 5/1934 | Bacon | 70/421 |
| 1,977,189 | 10/1934 | Larson | 70/407 |
| 4,229,957 | 10/1980 | Schneerson | 70/134 |

*Primary Examiner*—Robert L. Wolfe

*Attorney, Agent, or Firm*—Hill, Van Santen, Steadman & Simpson

[57] ABSTRACT

A lock and key combination includes profile shapes extending along the lateral faces of the key which extend at an angle relative to the key spine to make acquisition of replacement key copies more difficult.

11 Claims, 2 Drawing Sheets

LOCK AND KEY

BACKGROUND OF THE INVENTION

1. Field of the Invention

The present invention relates generally to a lock and key combination, and more specifically to improvements in the profile shape of the lateral faces of the key.

2. Description of the Related Art

It has become virtually impossible to control the acquisition of replacement key copies in lock and key systems since key blanks are available from sources other than the manufacture of the original lock and key systems. Provided suitable key blanks are available, duplicate key copies can be produced on conventional key cutting machines.

In a conventional key cutting machine, the key spine is used as a reference edge for exact fabrication of the notch depths.

SUMMARY OF THE INVENTION

An object of the present invention is to make the acquisition of replacement key copies more difficult and thereby provide a more secure lock and key system.

This and other objects are inventively achieved in a key and cylinder core having a profile shape proceeding at an angle greater than zero degrees relative to the key spine. This differs from the standard practice of providing the lateral profile shapes of a key parallel to the key spine. As used herein, the term "profile shape" refers to the generally longitudinally extending ridges and grooves formed in the lateral sides of a key and along the lateral inside surfaces of a cylinder core which inhibit the entry of other than a fitting key.

In a preferred embodiment of the invention, the profile shape of the key extends at an angle of between 5 and 10 degrees, inclusive, relative to the spine of the key. The angled profile substantially decreases the possibility of uncontrolled acquisition of duplicate keys. This is particularly true for individual fabrication of keys where no appropriate key blanks exist, since the angle of the profile to the key spine provides an additional degree of freedom to be taken into consideration in considering the possible key shapes, or "codes", which will open a lock.

In the present invention there is also the additional possibility of providing "chicanes" in the lock cylinder for interacting with the key spine so as to provide an additional type of key coding. Such chicanes can include undercut portions or projections extending into the keyway or key channel which interact with cut-out protions of the key spine.

DESCRIPTION OF THE PREFERRED EMBODIMENTS

Figure 1:
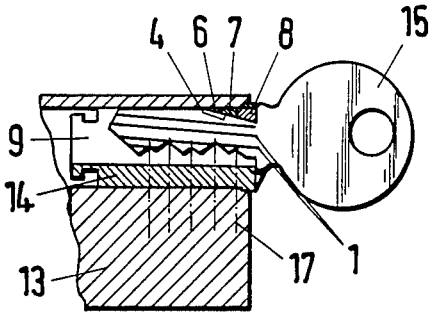
FIG. 1 is a cross section of a lock cylinder and a key according to the principles of the present invention.
Figure 2:
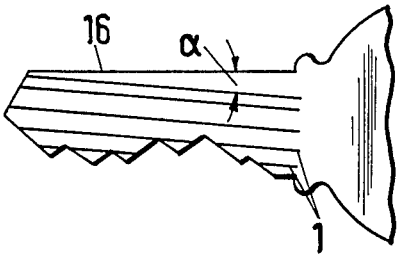
FIG. 2 is an enlarged side view of a key of the invention.

FIG. 1 shows a key 15 extending into a cylinder core 14 within a cylinder housing 13 of a lock. The key 15 includes a profile shape 1, in the form of grooves and ridges on the lateral portions of the key 15. As can be seen in FIG. 2,the profile shaping 1 lies at an angle $\alpha$ relative to a spine 16 of the key. Within the cylinder core 14 are a plurality of ridges and grooves (not shown) extending along the length of a keyway, or key channel, 9 and forming a corresponding profile for cooperative engagement with the profile shape 1 of the key 15. The corresponding profile of the cylinder core 14 lies at an angle substantially the same as the angle $\alpha$ of the key profile 1.

As with other keys, the key 15 is introduced into the keyway, or key channel, 9 in the cylinder core 14. However, the key 15 undergoes a somewhat upwardly slanting motion during insertion into the core 14. Depending upon the extent of the angle $\alpha$, however, the slanting motion is hardly noticed by a user of the present key. The profile shape 1 guides the key 15 into place so that notches in the key 15 can interact with standard key sensing devices, such as tumblers 17 indicated schematically in FIG. 1. Only if the angle $\alpha$ of the key profile 1 matches that of the cylinder core 14, are the notches properly aligned with the tumblers 17 to open the lock, depending of course on whether the notches are cut the respective appropriate depths.

The slightly slanting motion of the key 15 as it enters the keyway 9 enables further protective measures to be provided, such measures being referred to as "chicanes". The key spine 16 is tracked or cut in regions 4 in a suitable way and interacts with elements or projections 6, 7 and 8 in the cylinder core 14. The elements or projections 6, 7 and 8 are undercut and act as a detent during introduction of the key 15 into the keyway 9. Only a key 15 whose spine 16 is shaped to match to the particular arrangement of elements or projections 6, 7 and 8 can be completely introduced into the keyway 9.

Figure 3:
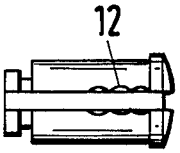
FIG. 3 is a plan view of a lock cylinder core including openings formed above the keyway.

To avoid having a universally ground key spine 16 which would enable complete introduction of a duplicate key and potential operation of the lock, assuming the duplicate key otherwise corresponds to the original, countersunk openings 12 are provided in the cylinder core 14 as shown in FIG. 3. One portion of the countersunk openings 12 is filled out by the elements or projections 6, 7 and 8 in accordance with the coding or cut out shape 4 of the key 15, while remaining portions of the counter sunk openings 12 remain free so that pins 17, shown in FIG. 5, can drop into the countersunk openings 12 upon rotation of the cylinder core 14 in the cylinder housing 13. Further rotation of the cylinder core 14, and opening of the lock, is thereby prevented. It is, of course, possible to fashion the countersunk openings so that the cylinder core 14 can be rotated back to its original position even though the pins 17 are engaged in the openings 12, such as by sloping the countersunk openings in a direction of rotation of the cylinder core 14.

Figure 4:
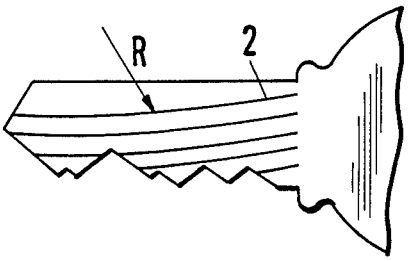
FIG. 4 is an enlarged side view of a second embodiment of a key of the present invention.

In further embodiments of the invention, the angle of the profile shape on the lateral portions of the key can change along the length of the key. For example, in FIG. 4 is shown a profile shape 2 which extends arcuately with a radius R along the length of a key 15.

Not only can the profile shape be angled upwardly, as shown in FIG. 2, but it is also possible to angle the profile shape downwardly. Either of these two possibilities include the further possibility of an arcuately, or otherwise non-linear, profile shape.

Figure 5:
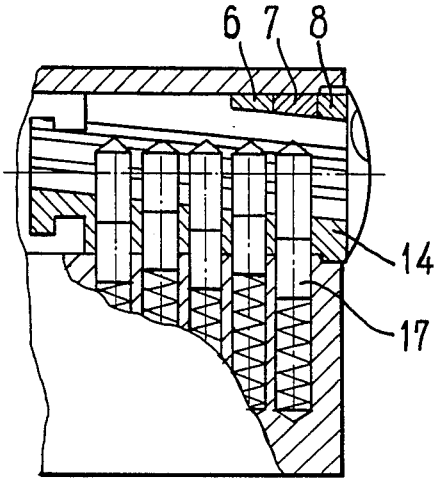
FIG. 5 is an enlarged cross section through the lock cylinder of FIG. 1, showing tumbler pins and elements or projections.
Figure 6:
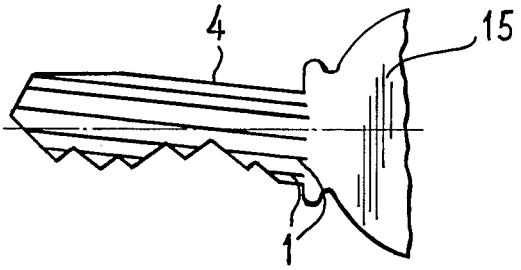
FIG. 6 is a side view of the key for use in the lock of FIG. 5 having a recess for the elements or projections.

Referring now to the illustrated cylinder core 14 of FIG. 5 and the fitting key 15 of FIG. 6, the profile shapes of both the key 15 and the core 14 lie on the same angle. Similarly, the faces of the elements or projections 6, 7 and 8 and the cut region 4 of the key 15 are at this same angle. The elements or projections 6, 7 and 8 extend into the cut region 4 when the key 15 is inserted into the core 14. If the cut region 4 is of the wrong shape for the elements 6, 7 and 8, either the lower portions of the corresponding tumbler pins 17 will extend into the countersunk openings and prevent unlocking of the lock, or the elements 6, 7 and 8 will prevent complete insertion of the key 15 into the key channel.

In conclusion, it is expedient to provide the profile shaping of the present invention beginning at the tip of the key to avoid sharp edges along the key spine 16.

Although other modifications and changes may be suggested by those skilled in the art, it is the intention of the inventor to embody within the patent warranted hereon all changes and modifications as reasonably and properly come within the scope of his contribution to the art.

I claim:

1. A lock and key, comprising:

a key having a spine and a profile shape proceeding at a first angle that differs from zero degrees relative to said spine of said key; and a cylinder core of said lock having a profile shape within said cylinder core corresponding to said profile shape of said key, said profile shape of said cylinder core proceeding at said first angle relative to an outside surface of said cylinder core.

2. A lock and key as claimed in claim 1, wherein said first angle of said profile shape of said key and said said cylinder core changes over its length.

3. A lock and key as claimed in claim 1, further comprising:

said cylinder core of said lock having elements or projections at one side, said elements or projections being undercut given introduction of a key into a keyway in said cylinder core, said key spine defining at least one recess for cooperation with said elements or projections to enable a fitting key to be completely introduced into said keyway.

4. A lock and key as claimed in claim 3, wherein said cylinder core includes countersunk openings in a region of said key spine when said key is in said keyway, one portion of said countersunk openings being capable of being filled by said elements or projections, and further comprising:

pins for dropping into remaining free portions of said countersunk openings upon rotation of said cylinder core by a key universally filed out at the key spine.

5. A lock and key, comprising:

a cylinder core having a generally cylindrical outside surface mounted in a cylinder housing and defining a key channel, said key channel having grooves and ridges extending generally along its length to form a profile shape, said profile shape proceeding at an angle which differs from zero relative to said cylindrical outside surface; and a key having a portion for insertion into said key channel of said cylinder core, said portion of said key having grooves and ridges extending generally along its length to form a complementary profile shape to said key channel profile shape, said complementary profile shape of said key proceeding at an angle relative to a spine of said key, said angle being substantially equal to said angle of said key channel profile shape.

6. A lock and key as claimed in claim 5, wherein said angle of said key profile shape and said angle of said key channel profile shape are each between 5 and 10 degrees, inclusive.

7. A lock and key as claimed in claim 5, further comprising:

tumbler pins movably mounted in said cylinder core along a first side of said key channel;

at least one projection extending into said key channel at a second side of said key channel; and a shaped spine of said key having a cut-out portion corresponding to said at least one projection in said key channel when said key is inserted into said key channel.

8. A lock and key as claimed in claim 7, wherein said cylinder core has at least one countersunk opening above said at least one projection, said at least one countersunk opening receiving at least one of said tumbler pins upon rotation of said cylinder core by a key having a shaped spine with a non-corresponding cut-out portion.

9. A lock and key as claimed in claim 5, wherein said profile shape of said key channel and said profile shape of said key both proceed along a curve of predetermined radius.

10. A lock and key as claimed in claim 1, wherein said profile shape proceeding at a first angle relative to said spine of said key extends in a substantially straight line.

11. A lock and key as claimed in claim 5, wherein said profile shape of said key channel and said profile shape of said key both proceed along a substantially straight line.

* * * * *